US010344497B1

(12) United States Patent
Martinez

(10) Patent No.: US 10,344,497 B1
(45) Date of Patent: Jul. 9, 2019

(54) INTERMENT APPARATUS AND METHODS

(71) Applicant: Walter Andres Martinez, Hawthorne, CA (US)

(72) Inventor: Walter Andres Martinez, Hawthorne, CA (US)

( * ) Notice: Subject to any disclaimer, the term of this patent is extended or adjusted under 35 U.S.C. 154(b) by 93 days.

(21) Appl. No.: 14/920,705

(22) Filed: Oct. 22, 2015

Related U.S. Application Data

(60) Provisional application No. 62/067,253, filed on Oct. 22, 2014.

(51) Int. Cl.
*E04H 13/00* (2006.01)

(52) U.S. Cl.
CPC ..... *E04H 13/008* (2013.01)

(58) Field of Classification Search
CPC ..... E04H 13/001; E04H 13/008; E04H 13/00; E04H 13/005
USPC ..... 52/136, 137, 128, 133, 139, 140, 141, 52/142; 27/1
See application file for complete search history.

(56) References Cited

U.S. PATENT DOCUMENTS 2,162,435 A * 6/1939 Hopkins ..... E04H 13/00 52/136
3,596,419 A * 8/1971 Jalbert ..... E04H 13/00 52/137
5,590,446 A * 1/1997 Hicks ..... E04H 13/00 27/1
8,161,694 B1 * 4/2012 Frost ..... E04H 13/00 52/128
8,209,918 B1 * 7/2012 Voit ..... E04H 13/003 52/103
8,943,762 B2 * 2/2015 Carlson ..... E04H 13/008 211/85.27

* cited by examiner

*Primary Examiner* — William V Gilbert
(74) *Attorney, Agent, or Firm* — Phillip D. Mancini

(57) ABSTRACT

A burial chamber apparatus and method of use provides for whole body burial of one or more persons, with a remaining burial chamber to receive cremated remains of multiple related descendents and/or others persons, when said persons meet a predetermined criterion set out by the buyer of the apparatus and/or burial plot.

5 Claims, 7 Drawing Sheets

INTERMENT APPARATUS AND METHODS

CROSS REFERENCE TO RELATED APPLICATIONS

The present application claims the benefit of priority to the U.S. Provisional Patent Application of the same title that was filed on Oct. 22, 2015, having application Ser. No. 62/067,253, which is incorporated herein by reference.

BACKGROUND OF THE INVENTION

The field of the invention is the burial of human remains, and more specifically an apparatus and method that allow for the adjacent burial of cremated remains of multiple persons via a burial vault that is capable of interment of one or more whole bodies.

There is a limited amount of space in existing cemeteries that are surrounded by urban and suburban developments. The desire by consumers or buyer family members to be buried in close proximity to relatives, or where living relatives dwell is an innate human desire that is becoming more expensive due to the imbalance of supply and demand.

Cremation has become a more common practice due to its lower costs, but leaves relatives of the deceased with the issue of placement or disposal of ashes. To date, there have been limited opportunities to memorialize the resting place of cremated remains with traditionally buried remains in a way that assures a common memorial location for several generations of a family.

Cemeteries face increasing costs if they can purchase adjacent land, as well as the uncertain future costs to develop and maintain this land.

Accordingly, it would be advantageous to provide a method of burial that meets the needs of consumers, allowing for close burial of related persons in existing cemeteries close to where they already live, yet at the same time provides a long-term revenue stream for cemeteries after existing plots are sold.

The above and other objects, effects, features, and advantages of the present invention will become more apparent from the following description of the embodiments thereof taken in conjunction with the accompanying drawings.

SUMMARY OF INVENTION

In the present invention, the first object is achieved by providing a burial vault comprising a lower rectangular chamber having a bottom and connected surrounding sides that extend upward to terminate in a first rectangular rim and being sized to provide a burial vault for at least one standard size casket, an upper rectangular chamber having a bottom and connected surrounding sides that extend upward to terminate in a second rectangular rim, each chamber being formed of an impermeable material, a first lid for sealing the second rectangular rim of the upper chamber that has one or more conduits extending upward through the lid to provide a means for depositing ashes in the upper rectangular chamber, each conduit having a sealable upper opening for receiving ashes after the lower and upper chambers are buried in the ground.

A second aspect of the invention is characterized by a burial vault further comprising a second lid for covering the first rim of the first rectangular chamber wherein the second rectangular chamber is disposed on the second lid.

Another aspect of the invention is characterized by a method comprising the steps of digging a hole or trench deep enough to place a burial vault and ashuary below ground, setting the burial vault in the hole or trench, placing the ashuary over the burial vault to be supported by the rim thereof, filling the hole to cover the ashuary with soil to a depth of at least about 12 inches.

Another aspect of the invention is characterized by the method further comprising the step of covering the burial vault at the rim thereof with a lid in which the ashuary is disposed on the lid.

Another aspect of the invention is characterized by the method in which a bottom of the ashuary covers the burial vault directly at the rim thereof.

Another aspect of the invention is characterized by a method comprising the steps of selling of at least one of the above apparatus and a grave site to one or more persons, with trust provisions to permit future burials of descends in the ashuary portion, pre-installation of the apparatus below ground, burial of a whole body in a lower chamber of the apparatus, sealing of the lower chamber, placing the ashuary over the lower chamber, covering of the ashuary with soil, and subsequently performing multiple interments of cremated remains in the upper ashuary that meet the trust provisions.

The above and other objects, effects, features, and advantages of the present invention will become more apparent from the following description of the embodiments thereof taken in conjunction with the accompanying drawings.

BRIEF DESCRIPTION OF THE DRAWINGS

FIG. 1A is a longitudinal cross-sectional elevation of a first embodiment of the apparatus; whereas

FIG. 2A is a longitudinal cross-sectional elevation of a second embodiment of the apparatus, whereas FIGS. 2B-2D are transverse cross-sectional elevations thereof at section line B-B in FIG. 2A, to better illustrate a method of using this embodiment of the apparatus.

DETAILED DESCRIPTION

Figure 1A:
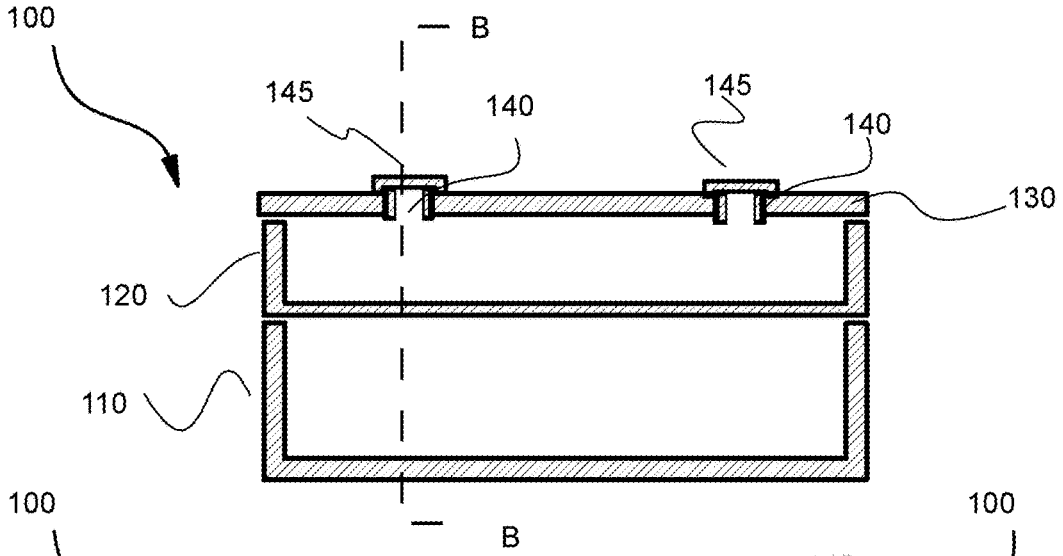
Figure 1B:
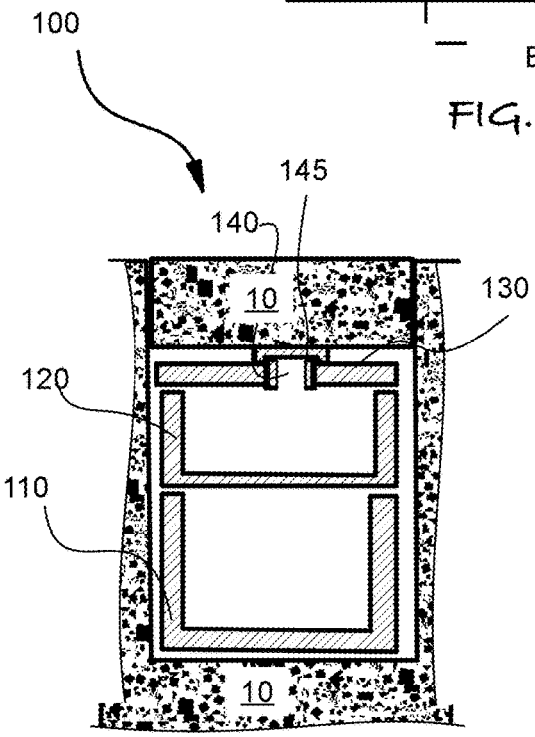
FIGS. 1B and 1C are transverse cross-sectional elevations thereof at section line B-B in FIG. 1A, both showing a method of use of the apparatus.
Figure 1C:
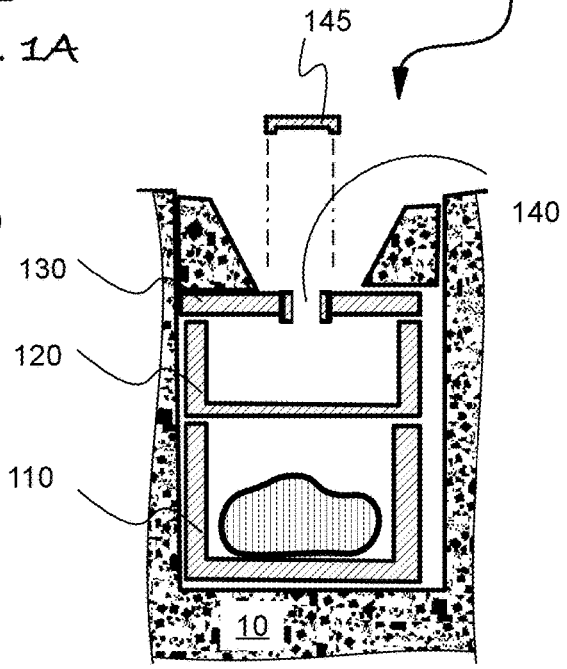

Referring to FIGS. 1A through 7, wherein like reference numerals refer to like components in the various views, there is illustrated therein a new and improved Interment Apparatus, generally denominated 100 herein, and methods of Interment, including a business method of contracting for burial of future generations that is cost effective for current buyers of a cemetery plot or plots.

In accordance with the present invention, the Interment Apparatus 100 comprises a burial vault 110 sized for 1 or 2 caskets 8 covered by a sealed or sealable ashuary chamber 120 sized to either provide a lid that seals the burial vault after one or more bodies 1 are interred therein, or alternatively be placed on the cover of a burial vault containing caskets 8, with the ashuary buried to at least a depth required by local laws, regulations or ordinance. The burial depth is at least 12 inches, which is permitted in California for a double casket burial vault, but more commonly at least 19 inches. The ashuary chamber 120 has lid 130 with one or more sealable openings 140 at the top.

More specifically, in reference to FIG. 1A, the burial vault has 110 has a generally rectangular bottom 111, surrounded by connected upright sidewalls 112 that terminate at a rim 113 to define a chamber. Further, the ashuary 120 is also a rectangular chamber defined by a rectangular bottom 121, surrounded by connected upright sidewalls 122 that terminate at a rim 123. The ashuary 120 is either covered or sealed by a lid 130 which engages rim 123 at the edges thereof, which is also generally planar and rectangular having preferably round openings 140 that are sealed by caps 145. The lid 130 is preferably sealingly adhered to the rim 123 with epoxy or another strong adhesive to permit handling and placement as a unit, in which case the bottom 121 thereof engages the rim 113 of the burial vault 110.

The lower chamber or burial vault dimensions depend on the number of caskets to be placed vertically, but typically have an interior depth of about 26" for a single casket, 49" for a double casket and 73" for a triple casket, with an interior width and length of 30"×86". The exterior dimensions are typically 4" larger on each side to provide a 4" thickness of concrete.

The apparatus 100 can be purchased at the time of need by the consumer and placed in the ground for immediate burial of a body 1 in the burial vault 110. As part of the burial process, the ashuary chamber 120 can seal the rim of the burial vault, the top of which is then covered by circa 12 inches of soil, but more preferably at least 18 inches of soil or suitable fill material.

The apparatus can also be pre-buried by the cemetery, in which case at the time of need for burying remains, the soil is excavated to remove the ashuary chamber with the lid 130 thereof, so the burial vault is open to receive a body 1. It should be understood that burial vaults can vary in width and height and can be buried deep enough to accommodate 3 or more whole bodies.

The ashuary 120 can have any depth, but is preferably no deeper or heavier than the burial vault 110 to facilitate handling with the same equipment used to transport and bury the vault 110.

More preferably, the ashuary chamber 120 has a height or depth of about half the burial vault 110, or about 15 to 20 inches, so that it can be buried under about 12 inches of soil 10 to meet most regulations for burial depth of the vault 110, but still provide for access to covering 145 of each of the sealable openings. Hence, as shown in FIG. 1D, when it is desired to place cremated remains 2 of relatives in the ashuary, only a limited amount of excavation of soil or fill material 10 with a shovel is needed to reach and remove the covering 145, to open and place cremated remains 2 in the ashuary chamber 120, as either granular remains, bagged granulated remains, or granulated remains held in a decorative or commemorative urn 3. The ashuary 120 has a sufficient size to hold the remains of 20 to 30 individuals. The interior dimensions are about 13" high with a width and length of about 30 and 80 inches respectively. The wall thickness can be 4-5 inches when made of reinforced concrete, but can be thicker or thinner when made of other materials, and need not be made of the same material as the burial vault 110 that received caskets and whole bodies.

The cemetery obtains a stream of future revenue by charging for services to excavate and use the ashuary 120 for each additional interment, but saves the consumers' expenses as the fees are much less than to purchase and use an entire burial plot.

The purchasers of the original plot and the apparatus will likely spend more than for a standard burial vault, but have the peace of mind of knowing their descendants will be buried with them in the future, and that they have endowed a lasting legacy and memorial space to their family.

Hence, the apparatus 100 as used in the above methods provided for improved utilization of cemetery space, with higher current revenue for sales of a more expensive burial vault, yet with a longer-term revenue stream for cemeteries with limited capacity for expansion.

Future generations of the family will have available a low-cost burial alternative, should they elect for cremation. This is accomplished by the business method of the sale of the apparatus and/or grave site to one or more persons, with trust provisions to permit future burials of descends in the ashuary portion, with the option for pre-installation of the apparatus below ground before a first burial of a whole body in a lower chamber of the apparatus, which is followed by the sealing of the lower chamber with the ashuary and then the step of covering of the ashuary with soil. Thereafter, multiple interments of cremated remains in the upper ashuary are carried out subject to the deceased persons having their remains interred meet the trust provisions, which can be at the discretion of one or more of the named or designated trustees.

Other preferred aspects of the apparatus are that the ashuary 120 or upper chamber is no more than half the height of the lower chamber, or that the ashuary 120 or upper chamber has a height that is sufficiently small to be covered with at least 12 inches of soil when disposed on top of a burial vault that is buried at a conventional depth to meet customary practices and/or governmental rules, regulations and/or ordinances.

The lid 130 of the ashuary 120 is preferably sealed at the rim 123 thereof before initial burial, which can be a pre-burial before it or the burial chamber is needed to receive human remains, or after a first or second burial, or any additional burial of a whole body in the burial vault portion below it.

Lid 130 of the ashuary 120 has one or more openings 140 sized to received bags or urn 3 sealed cremated remains. Accordingly, the opening 140 preferably has a diameter of about 10 inches. More preferably, two openings 140 are spaced from the transverse ends 126.

The ashuary 120 preferably also has means for grasping to permit lifting and transport thereof from above, to enable placement above the burial vault or lower chamber intended to receive caskets. Such means for grasping can include side or lower edge notches, or other means for preventing cables disposed underneath from sliding, or side hooks or eyelets and the like.

Figures 2A, 2B, 2C, 2D:
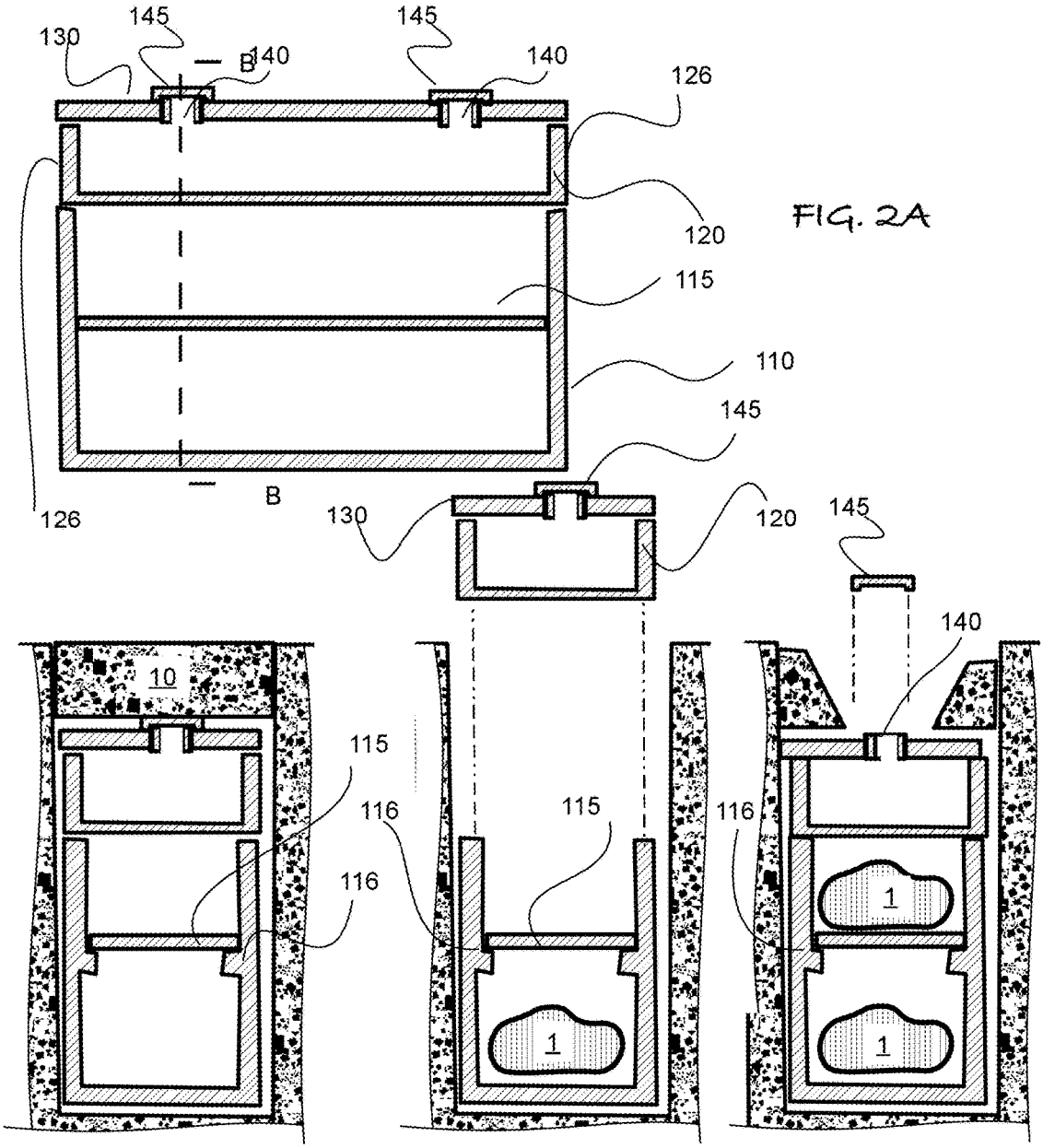
Figure 3:
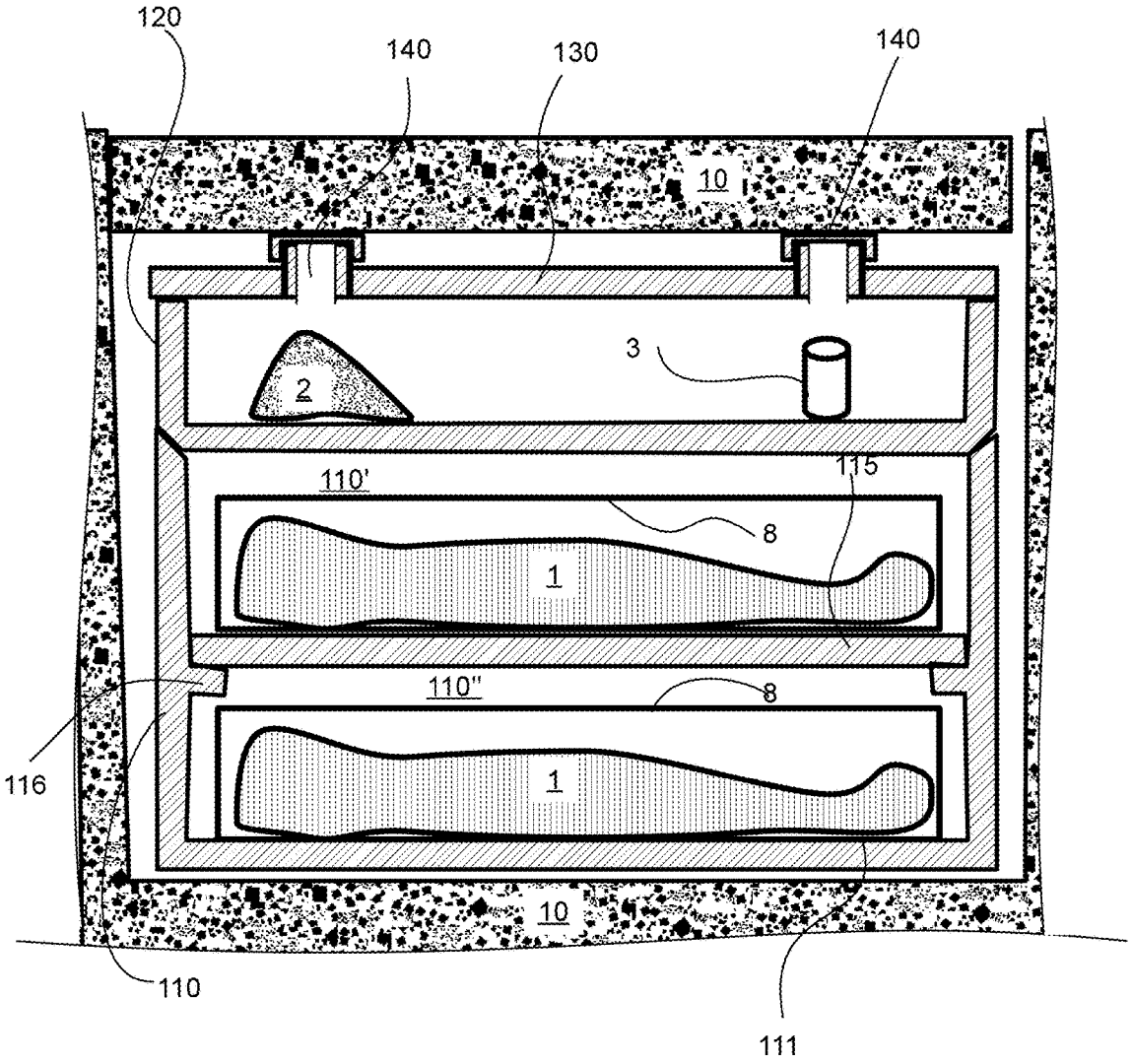
FIG. 3 is a longitudinal cross-sectional elevation of the second embodiment of the apparatus showing a subsequent step in the method of use to FIG. 2D.
Figure 4:
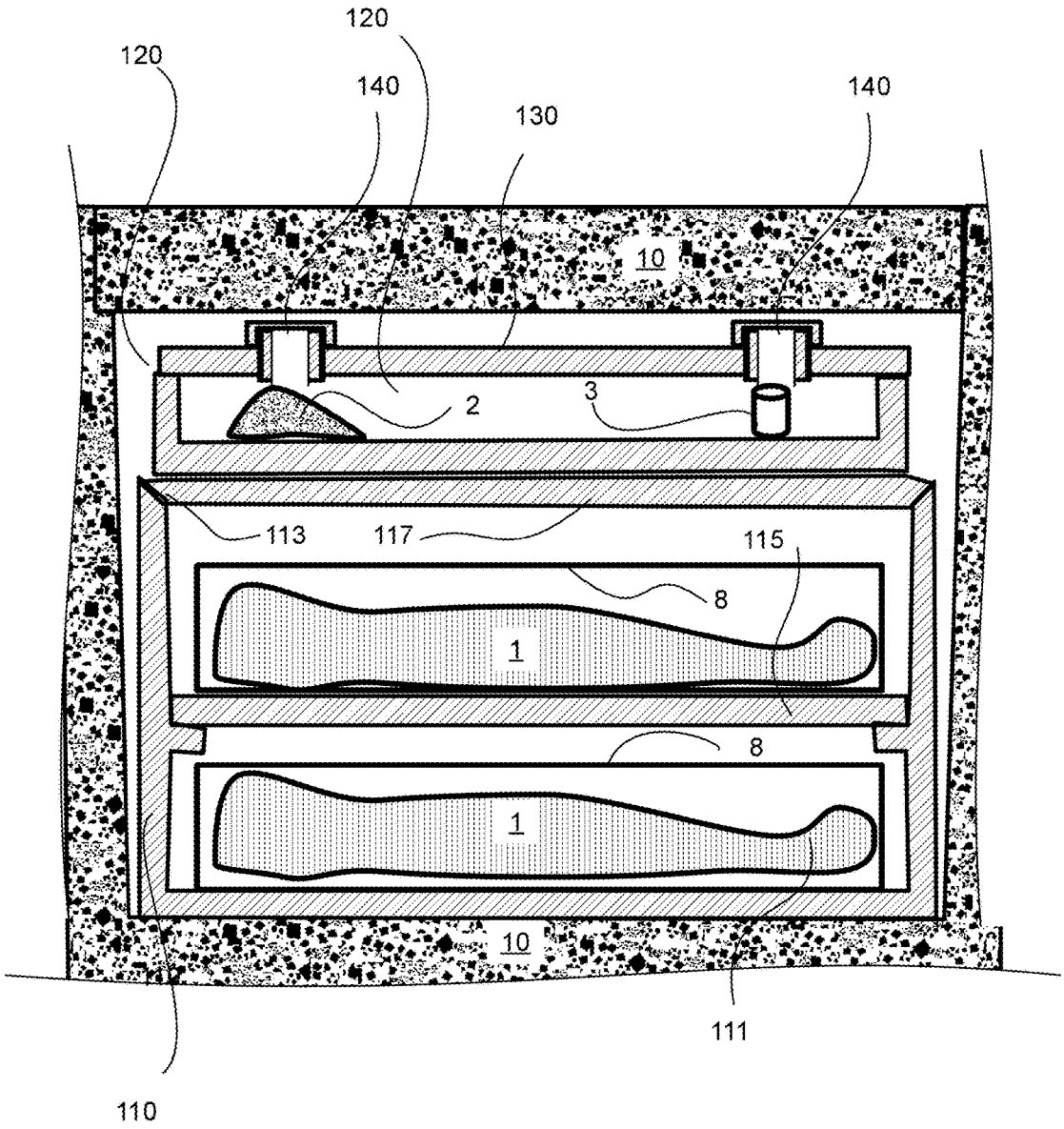
FIG. 4 is a longitudinal cross-sectional elevation of a third embodiment of the apparatus showing a subsequent step in the method of use.

As shown in the second embodiment in FIGS. 2-4, a portion of the apparatus 100 that comprises the burial vault 110 can be of a sufficient height to accommodate two whole bodies 1 in full size caskets 8 (FIG. 3), each casket in one or more sub-chamber, one disposed above the other. In FIGS. 2A-D to FIG. 5, the upper 110' and lower 110" sub-chamber are separated by a removable shelf 115 that rests on a ledge or flange 115 formed on two or more opposing sides or edges of the sidewalls of the lower sub-chamber. The removable shelf 115 is provided to receive a second casket or body 1 above a first whole body 1, which when buried, is disposed either directly on the bottom 111, or in a casket 8 or other support on bottom 111. Alternatively, each sub-chamber can be a separate burial vault 110, in which the bottom of each upper sub-chamber seals the rim of the lower sub-chamber.

In the embodiment of FIG. 3, the bottom 121 of the ashuary 120 covers the burial vault 110 at the rim 113 thereof. Therefore, in the process of use shown in FIGS. 2B-2D, in which the apparatus 100 is pre-installed, as shown in FIG. 2B, the soil 10 is excavated to remove the ashuary 120 and shelf 115, so a first body 1 or body within a casket 8 can be buried, after which the ashuary 120 is placed over the burial vault 110, and covered with soil to at least about 12 inches. After a second burial, shown in FIG. 2D, only a small amount of soil is excavated over the covered opening 140 in the ashuary lid 130, so the opening cover 145 can be removed to place cremated remains in the ashuary 120. As shown in the various side cross-sectional elevations in FIG. 3-5, cremated remains can be added as ashes 2 or sealed in container 3, and either opening 140 can be used until the ashuary 120 is full.

Figure 5:
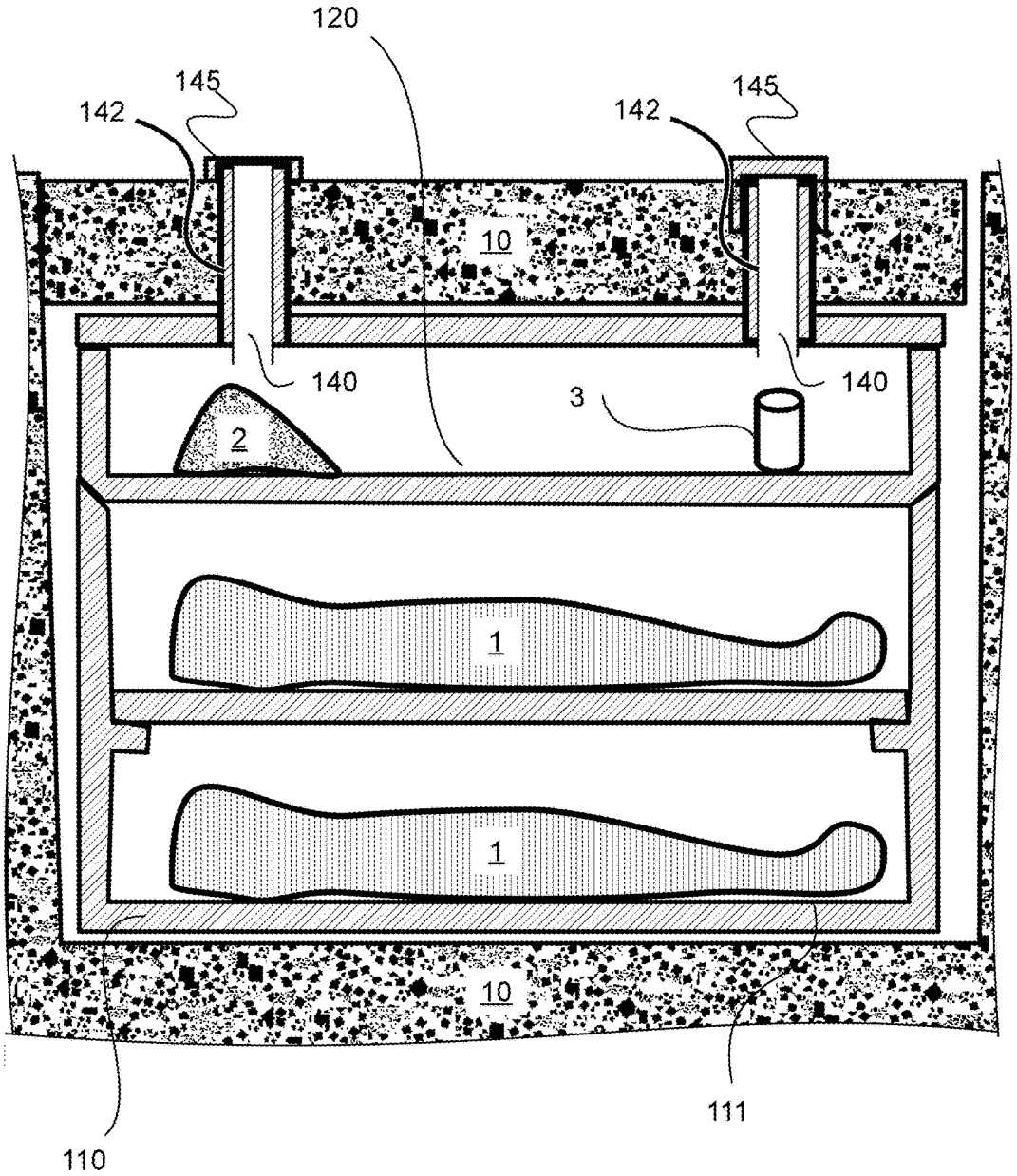
FIG. 5 is a longitudinal cross-sectional elevation of a fourth embodiment of the apparatus showing a subsequent step in the method of use.

In the embodiment of the invention illustrated in FIG. 5, the burial vault is covered by a lid 117 at the rim 113, and the ashuary 120 is installed on top of the lid 117. In this case, the ashuary 120 can have a smaller width and length than the rim of the burial vault.

As shown in FIG. 5, the opening 140 optionally extend upward by at least about 12 inches or more depending on the intended burial depth, by a vertical conduit 142, which can be formed of plastic or metal pipe. The vertical conduits 142 can extend upward to substantially all of the burial depth. This permits access to the ashuary 120 by removing the cover 145 of the vertical conduit 142 with a minimum of excavation. The cover 145 can be under a removable monument or plaque for protection.

Figure 6:
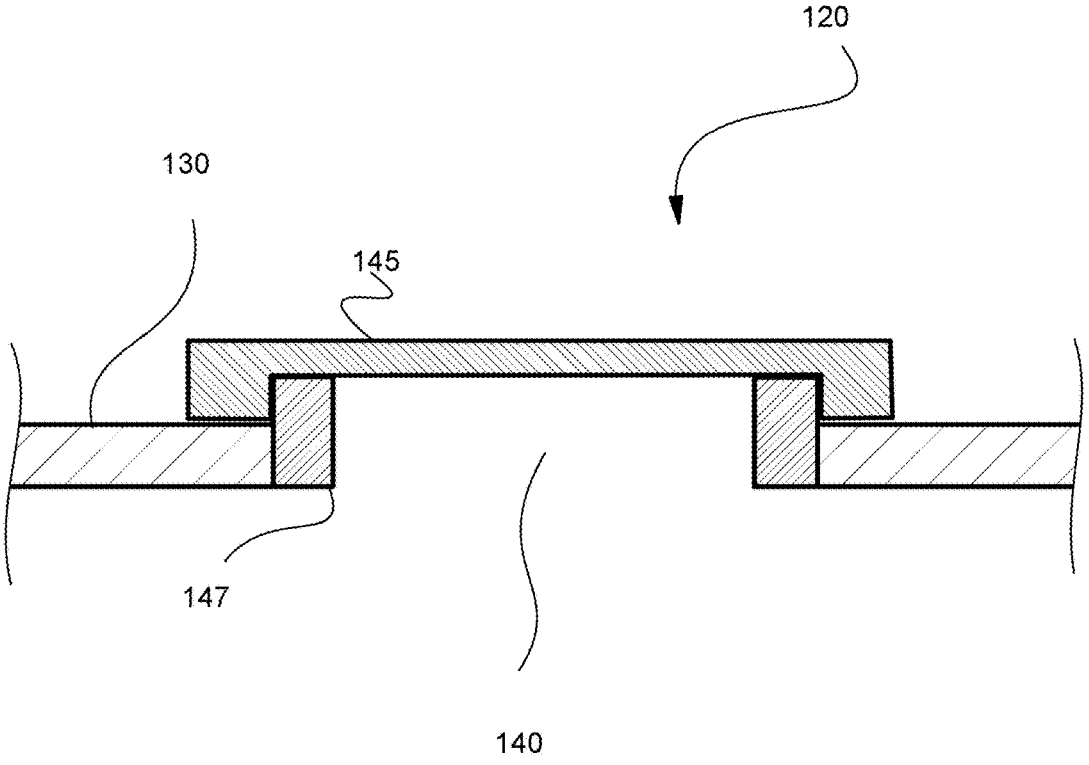
FIG. 6 is an expanded longitudinal cross-sectional elevation of a portion of another embodiment showing the detailed construction of the covered opening in the ashuary portion.

As shown in FIG. 6, the opening 140 in the ashuary lid 130 is preferably surrounded by a section of plastic or metal pipe 147 that is inserted prior to casting the lid 130 so the pipe 147 is surrounded by iron or steel reinforced concrete. The vertical conduit 142 in FIG. 5 can be formed in the same manner.

Figure 7:
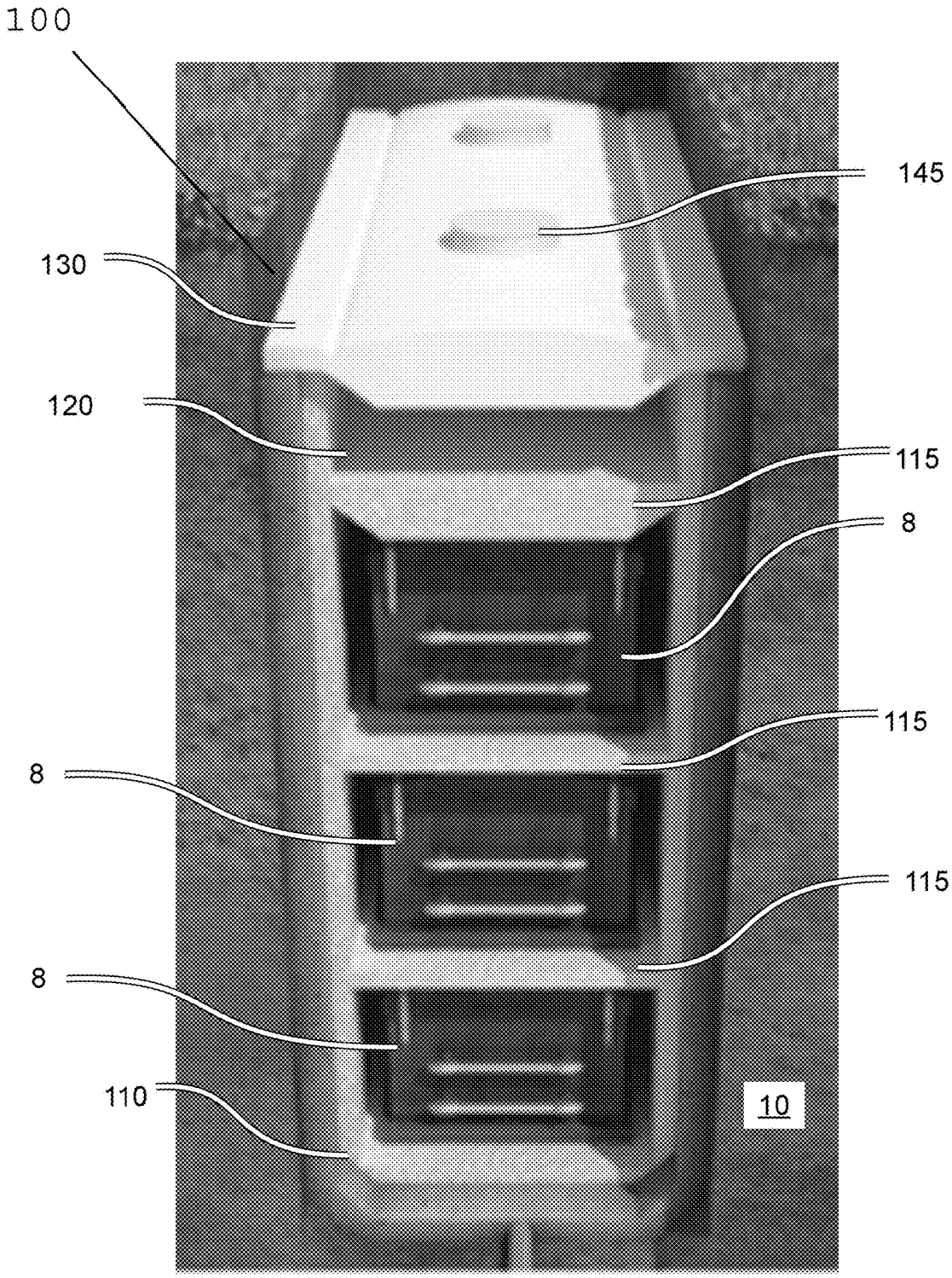
FIG. 7 is a perspective cut-away view of another embodiment of the invention showing the interment apparatus holding 3 coffins on 2 shelves and the ashuary chamber defined by an upper shelf above the upper coffin.

As shown in FIG. 7, another embodiment of the interment apparatus 100 holds three coffins 8 on two shelves 115 and the ashuary chamber 120 is defined by an upper shelf over the upper coffin 8 in the vault 110. The vault 110 can be built or lowered into a pre-buried or cast outer vault.

It should be appreciated that the burial vaults, ashuary chamber and lids are preferably made of steel reinforced concrete. However, such vaults can also be metal or metal or fiberglass lined reinforced concrete.

Another aspect of the invention is a method comprising the steps of selling of at least one grave site to one or more persons, with trust provisions to permit future burials of descends in the ashuary portion of the apparatus once it is installed. The installation and sale of the apparatus can be at a time of need, or in the future. In either case, a cemetery may choose to pre-install the apparatus when large scale excavations are done to take advantage of economies of scale in mass pre-installation of burial vaults and associated ashuary sub-chambers therewith. Once at least the lower chamber or burial vault portion of the apparatus is installed ground, the burial of a whole body in a lower chamber of the apparatus can occur. The lower chamber is then covered with either a lid, or the ashuary as the lid, or the ashuary over the lid, with the remainder of the hole filed with soil, typically to a depth of at least about 12 inches. If there is additional space in the lower chamber for whole body burial, then the cover or ashuary can be removed for subsequent burials.

Once the ashuary is in place over the lower chamber or burial vault portion, multiple interments of cremated remains can be made in the upper ashuary, provided they meet the trust provisions. That is, the cremated remains are those that meet criteria set out by the purchasers of the burial plot and/or apparatus, such as being either named descendants, or unnamed descendants that future trustees have the option, if not the obligation, to offer burial space therein. In according with this method, the original purchasers of the burial plot have the assurance of providing a common burial location for descendants, with associated options for suitable memorials or family marking at the same site.

While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A burial vault comprising:

a) a lower rectangular chamber having a first bottom portion and first connected surrounding sides that extend upward to terminate in a first rectangular rim and being sized to provide a burial vault for at least one casket, b) an upper rectangular chamber disposed over the lower rectangular chamber and having a second bottom portion and second connected surrounding sides that extend upward to terminate in a second rectangular rim, the second bottom portion resting above first rectangular rim and forming a first lid over the lower rectangular chamber, each of the lower and upper chamber being formed of a fluid impermeable material, c) a second lid sealing the second rectangular rim of the upper chamber having one or more conduits extending upward, away from the lower rectangular chamber, through the second lid, each conduit having a sealable upper opening for receiving ashes after the lower and upper chambers are buried in the ground.

2. The vault according to claim 1, wherein being sized to provide a burial vault for at least one casket comprises having interior dimensions of approximately 30 inches wide by 86 inches long and 26 inches deep.

3. The vault according to claim 1, wherein the fluid impermeable material comprises a material selected from the group consisting of concrete, steel-reinforced concrete and fiberglass-reinforced concrete.

4. A method of burial comprising the steps of:

a) digging a hole or trench deep enough to accommodate a burial vault and an ashuary below ground, b) setting the burial vault in the hole or trench, the burial vault comprising a first box-like structure having a bottom portion and four side walls projecting upward from the bottom portion and terminating in a rectangular shaped rim, c) placing the ashuary over the burial vault to be supported by the rectangular shaped rim thereof, the ashuary comprising a second box-like structure with cross-sectional dimensions matching the burial vault and two or more conduits passing through a lid of the ashuary in a direction away from the burial vault so that the two or more conduits sit at least one foot below grade, d) back filling the hole to cover the ashuary and vault with soil, wherein placing the ashuary over the burial vault comprises setting a bottom portion of the ashuary directly on the vault's rectangular shaped rim.

5. The method of claim 4 further comprising the step of covering the burial vault at the rim thereof with a lid and placing the ashuary on the lid.

* * * * *